US006390108B1

(12) United States Patent
Lin et al.

(10) Patent No.: US 6,390,108 B1
(45) Date of Patent: May 21, 2002

(54) ECONOMIC DOUBLE-STORY UMBRELLA

(75) Inventors: Chung-Kuang Lin; Jung-Jen Chang, both of Taipei Hsien (TW)

(73) Assignee: Fu Tai Umbrella Works Ltd., Taipei Hsien (TW)

( * ) Notice: Subject to any disclaimer, the term of this patent is extended or adjusted under 35 U.S.C. 154(b) by 0 days.

(21) Appl. No.: 09/784,155

(22) Filed: Feb. 16, 2001

Related U.S. Application Data

(63) Continuation-in-part of application No. 09/727,576, filed on Dec. 4, 2000.

(51) Int. Cl.[7] ..... A45B 15/00; A45B 25/18
(52) U.S. Cl. ..... 135/33.41; 135/33.7
(58) Field of Search ..... 135/33.7, 33.41, 135/33.4, 33.2, 93, 94, 115, 119, 120.3

(56) References Cited

U.S. PATENT DOCUMENTS 4,979,534 A * 12/1990 Johnson et al.

FOREIGN PATENT DOCUMENTS

AT 106457 * 5/1927 ..... 135/33.7

* cited by examiner

*Primary Examiner*—Robert Canfield
(74) *Attorney, Agent, or Firm*—Troxell Law Office PLLC

(57) ABSTRACT

An economic double-story umbrella includes: an upper umbrella formed by an upper umbrella cloth; and a lower umbrella having a shaft and a rib assembly pivotally secured to the shaft for securing a lower umbrella cloth on the rib assembly; having an upper buckling member formed on the upper umbrella cloth and a lower buckling member formed on the lower umbrella cloth coupled with the upper buckling member for forming the double-story umbrella when opening the umbrella; whereby upon uncoupling of the upper and lower buckling members when closing the umbrella, the upper umbrella cloth will be compactly folded to enwrap the lower umbrella as folded for conveniently storing the umbrella.

8 Claims, 6 Drawing Sheets

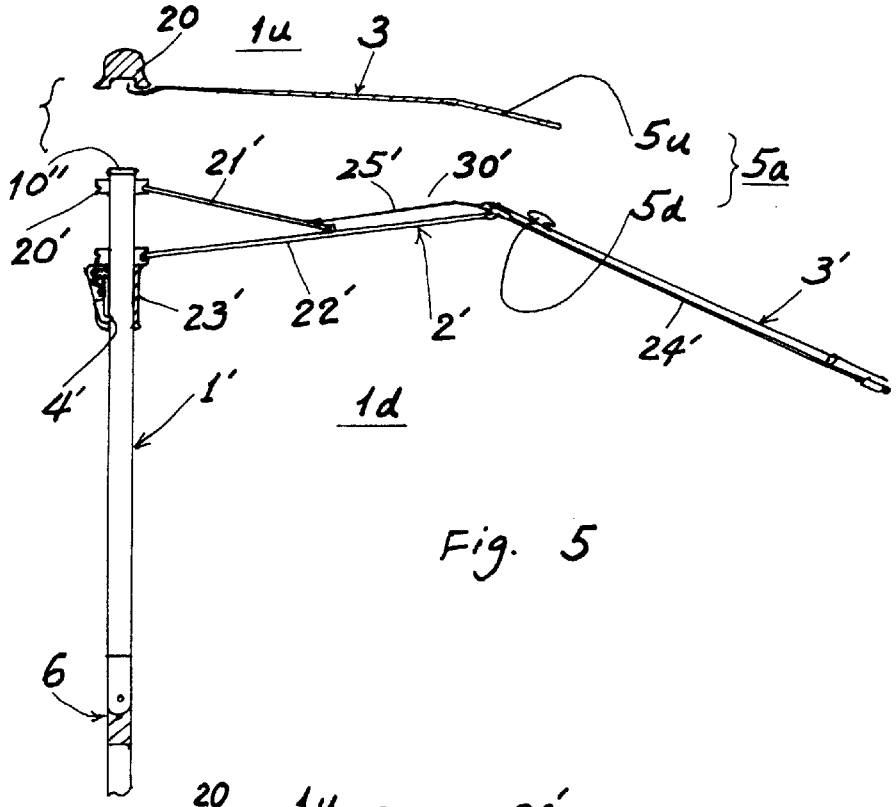
Fig. 5
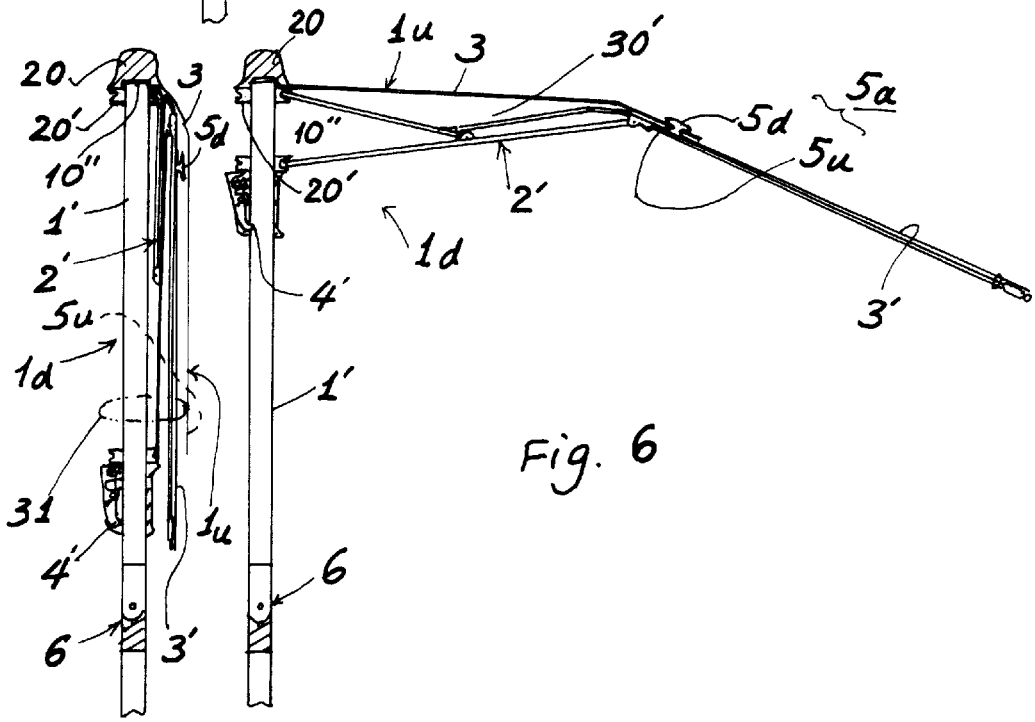
Fig. 6
Fig. 7

ECONOMIC DOUBLE-STORY UMBRELLA

This application is a Continuation-in-Part (C-I-P) of a prior application Ser. No. 09/727,576 entitled: "Double-story Umbrella" filed on: Dec. 4, 2000 by the same inventors of this application.

BACKGROUND OF THE INVENTION

The prior application disclosed a double-story umbrella including an upper umbrella, and a lower umbrella detachably coupled with the upper umbrella and operatively opened to be a big umbrella having large shielding area. However, the upper umbrella still requires an upper shaft (1), an upper rib assembly (2) pivotally secured to the upper shaft (1), and an upper umbrella cloth (3) secured on the upper rib assembly (2) for constructing the upper umbrella, which may increase the production complexity, cost, and operational inconvenience.

The present inventors have found the drawbacks of the prior application and invented the present economic double-story umbrella.

SUMMARY OF THE INVENTION

The object of the present invention is to provide an economic double-story umbrella including: an upper umbrella formed by an upper umbrella cloth; and a lower umbrella having a shaft and a rib assembly pivotally secured to the shaft for securing a lower umbrella cloth on the rib assembly; having an upper buckling member formed on the upper umbrella cloth and a lower buckling member formed on the lower umbrella cloth coupled with the upper buckling member for forming the double-story umbrella when opening the umbrella; whereby upon uncoupling of the upper and lower buckling members when closing the umbrella, the upper umbrella cloth will be compactly folded to enwrap the lower umbrella as folded for conveniently storing the umbrella.

BRIEF DESCRIPTION OF THE DRAWINGS

FIG. 5 is an illustration of a separated upper umbrella and lower umbrella.

FIG. 6 is an illustration of the present invention when assembling the upper and lower umbrellas as shown in FIG. 5.

FIG. 7 shows a folded umbrella of the present invention as folded from FIG. 6.

DETAILED DESCRIPTION

Figure 1:
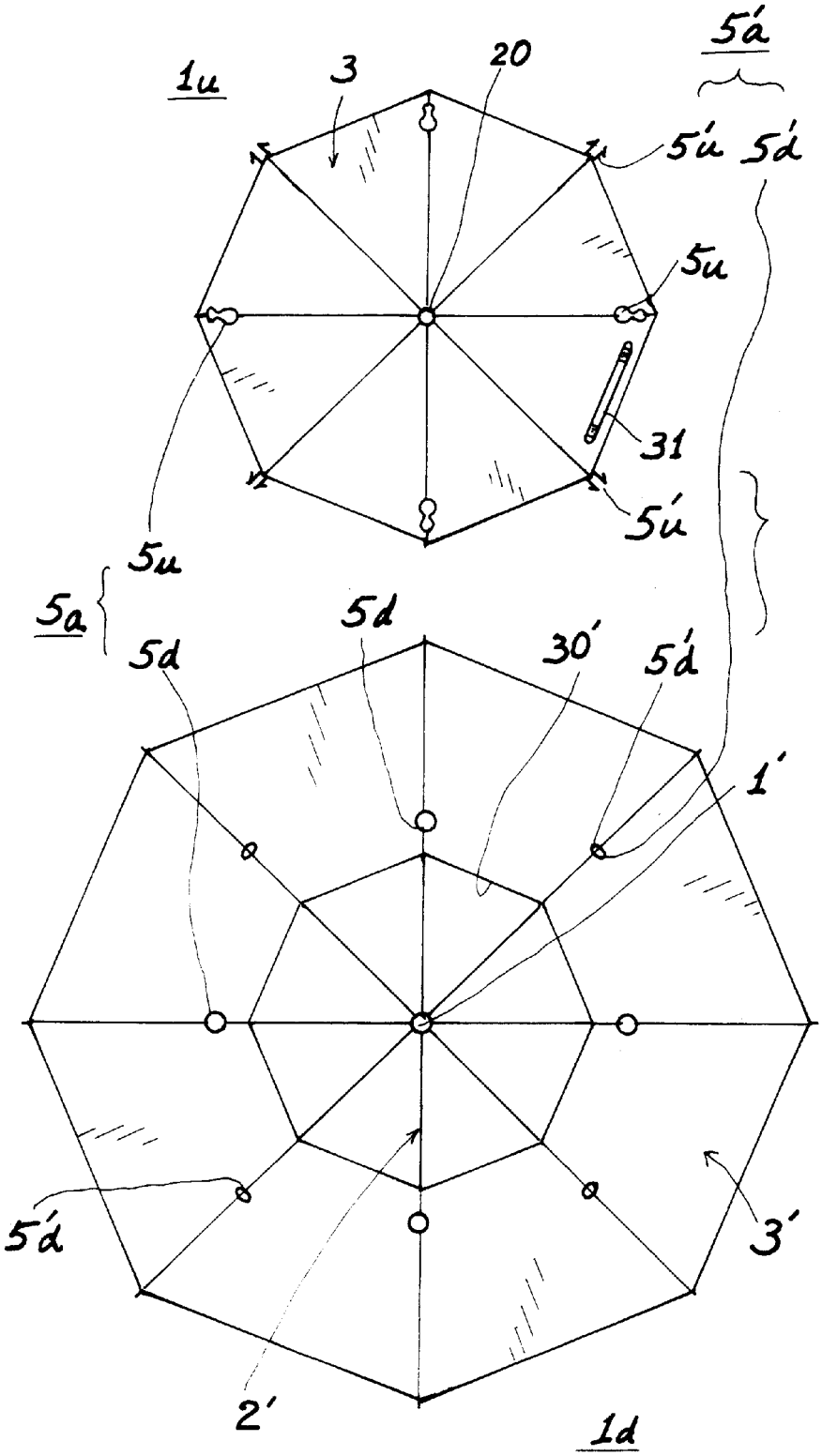
FIG. 1 is a top view illustration showing the upper and lower umbrella cloths of the double-story umbrella of the present invention.

As shown in FIGS. 1~7, the economic double-story umbrella of the present invention comprises: an upper umbrella 1*u* and a lower umbrella 1*d* detachably coupled with the upper umbrella 1*u* to form a double-story umbrella such as a beach umbrella or umbrella with large diameter for increasing a shielding area.

The lower umbrella 1*d* includes: a lower shaft 1', a lower rib assembly 2' pivotally secured to the lower shaft 1', a lower umbrella cloth 3' secured to the lower rib assembly 2', and a lower spring catch 4' resiliently lockable on the lower shaft 1' for locking the lower rib assembly 2' at its opening state as shown in FIGS. 5, 6. The lower rib assembly 2' may be single fold or multiple folds. The rib assembly 2' as shown in the drawing figures includes: an inner rib 21' pivotally secured to a notch 20' formed on a top of the lower shaft 1', a lower stretcher rib 22' pivotally secured to a lower runner 23' slidably held on the lower shaft 1' and lockable on the shaft 1' by the lower spring catch 4' when opening the umbrella, and a lower tail rib 24' pivotally secured to an outer end of the stretcher rib 22' and having an innermost end of the tail rib 24' pivotally secured to the inner rib 21' by an auxiliary rib 25'; having an outermost end of the inner rib 21' pivotally secured to the stretcher rib 22'.

The upper umbrella 1*u* includes: an upper umbrella cloth 3 having its central portion secured, fastened or formed on a top 10" of the lower shaft 1' (as shown in FIGS. 6, 7) by a cap 20; and a plurality of upper buckling members 5*u* or 5'*u* radially formed on an outer periphery of the upper umbrella cloth 3 and each engageable with a lower buckling member 5*d* or 5'*d* formed on the lower umbrella cloth 3', with each upper buckling member 5*u* (or 5'*u*) and each lower buckling member 5*d* (or 5'*d*) forming a detachable buckling means 5*a* (or 5'*a*) in accordance with the present invention. The plurality of detachable buckling means 5*a* (or 5'*a*) are radially disposed on the umbrella cloths 3, 3'.

Naturally, the lower buckling member 5*d* may be directly or integrally formed on the lower rib assembly 2' and then protruded outwardly (or upwardly) through the lower umbrella cloth 3' in order to be engaged with the upper buckling member 5*u* for coupling the upper cloth 3 on the lower cloth 3'.

Figure 2:
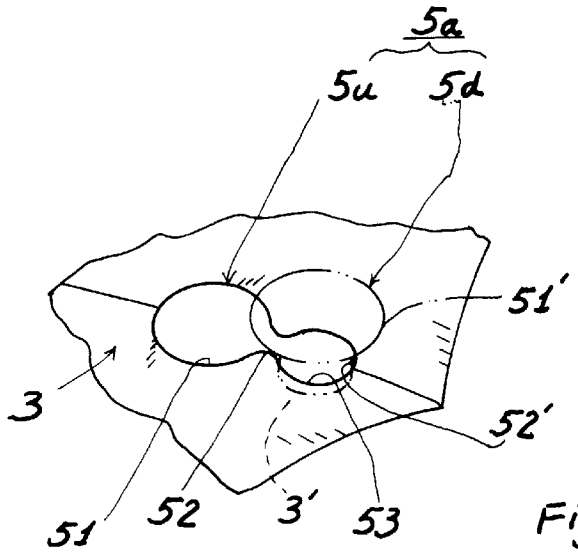
FIG. 2 is a perspective illustration showing the coupling of the upper and lower buckling members of the present invention.
Figure 3:
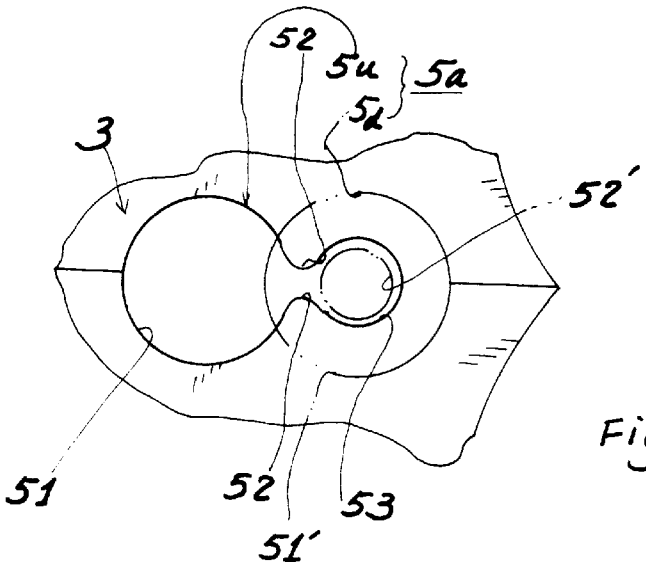
FIG. 3 is a top view of the present invention as shown in FIG. 2.

As shown in FIGS. 1, 2 and 3, each detachable buckling means 5*a* includes: an upper buckling member 5*u* formed on an outer periphery of the upper umbrella cloth 3 with each upper buckling member 5*u* formed as calabash shape including a large-diameter hole 51, a throat portion 52 and a small-diameter hole 53 having a diameter smaller than that of the large-diameter hole 51 but larger than a width of the throat portion 52; and a lower buckling member 5*d* formed on an inner periphery of the lower umbrella cloth 3' adjacent to a central opening 30' of the lower umbrella cloth 3' with each lower buckling member 5*d*, which is corresponding to and engageable with each upper buckling member 5*u*, including a button 51' having a diameter generally equal to or slightly larger than the diameter of the large-diameter hole 51 of the upper buckling member 5*u* for a quick or instant passing of the button 51' through the large-diameter hole 51 of the upper buckling member 5*u*, and a neck portion 52' positioned under the button 51' and engageable with the small-diameter hole 53 of the upper buckling ember 5*u*; whereby upon engagement of the button 51' with the large-diameter hole 51 to preliminarily put the upper cloth 3 on the lower cloth 3' and then moving the button 51' to the location of the small-diameter hole 53 by engaging the neck portion 52' with the small-diameter hole 53 for stably engaging the upper buckling member 5*u* with the lower buckling member 5*d* for coupling the upper cloth 3 above the lower cloth 3'.

When assembling the present invention, the lower umbrella 1*d* is first opened and the cap 20 is provided to cap and fasten the central portion of the upper cloth 3 on the top of the shaft 1' of the lower umbrella 1*d*. The button 51' is allowed to pass through to large-diameter hole 51 of the upper buckling member 5*u* to "wear" the upper cloth 3 on the lower cloth 3' and the tension force of the opening umbrella of the present invention will accordingly pull the cloth 3 radially to engage the neck portion 52' of the lower buckling member 5*d* with the small-diameter hole 53 of the upper buckling member 5*u*, thereby stably coupling the upper cloth 3 on the lower cloth 3' for shielding the opening 30' for stably opening the umbrella of the present invention.

Even upon wind blowing, the air will pass through the central opening 30' of the lower cloth 3' to escape through each aperture between every two buckling means 5*a*, 5'*a* and between the upper and lower cloths 3, 3' to prevent damage of the umbrella when subjected to a strong wind.

Figure 4:
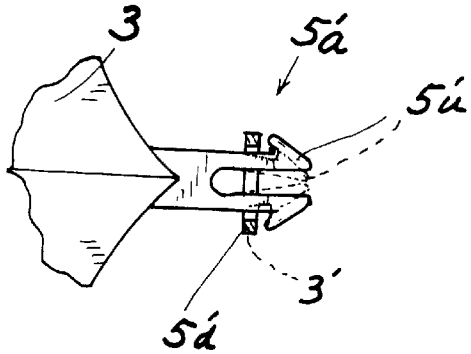
FIG. 4 is an illustration showing the coupling of the upper and lower buckling members of a preferred buckling means in accordance with the present invention.

As shown in FIGS. 1, 4, another preferred embodiment of the buckling means 5'*a* includes: an upper buckling member 5'*u* formed as a pair of bifurcated hook members on an outer perimeter of the upper umbrella cloth 3, and a lower buckling member 5'*d* formed as a loop formed on the lower umbrella cloth 3' to be engageable with the pair of bifurcated hook members of the upper buckling member 5'*u*. When protruding the bifurcated hook members 5'*u* through the loop 5'*d* as shown in FIG. 4, the bifurcated members 5'*u* will be resiliently extended to be stably locked on the loop 5'*d* thereby coupling the upper cloth 3 on the lower cloth 3'.

When folding the umbrella from FIG. 6 to FIG. 7, the lower umbrella 1*d* is closed and the upper and lower buckling members 5*u*, 5*d* (or 5'*u*, 5'*d*) are disengaged; the upper umbrella cloth 3 is downwardly pulled to enwrap the lower umbrella cloth 3', the lower rib assembly 2' and the shaft 1' as folded to form a compact folded umbrella for convenient storage.

A tying means 31 such as a fastening belt, a Velcro tape or the like as formed on the upper cloth 3 may be provided for tying and fastening the umbrella cloths 3, 3' when folding the umbrella of the present invention.

The detachable buckling means 5*a* (or 5'*a*) provides a coupling and uncoupling mechanism for the upper and lower cloths 3, 3'. When closing the umbrella, the upper cloth 3 is uncoupled from the lower cloth 3' by disengaging the upper buckling member 5*u* from the lower buckling member 5*d* to thereby prevent the upper cloth 3 from being wrinkled and clamped by the ribs of the rib assembly 2' of the lower umbrella 1*d* since the upper cloth 3 is uncoupled and downwardly pulled to be separated from the central portion of the lower umbrella 1*d* and separated from the folded ribs of the rib assembly 2' (FIG. 6 to FIG. 7), thereby without being "jammed" by the folded ribs. Otherwise, the thick umbrella cloth 3, once being jammed by the ribs of the rib assembly 2', will not be completely folded to become a compact umbrella due to the wrinkled umbrella cloth 3.

The upper umbrella 1*u* of the present invention has been simplified to be an umbrella cloth 3 by eliminating those complex elements including the upper rib assembly and upper shaft as disclosed in the prior U.S. patent application, thereby simplifying the production and decreasing the cost.

The coupling or uncoupling of the buckling means 5*a* is as easy as the wearing or take-off of a garment. Once uncoupled, the upper cloth 3 may be quickly folded to enwrap the lower cloth 3' to be a compact folded umbrella for its convenient storage.

The angle-adjusting means 6 is provided to pose or tilt the shaft 1' of the umbrella on a base or stand to a desired angle such as for satisfactorily shielding the sunlight.

The present invention may be modified without departing from the spirit and scope of the present invention. The buckling means 5*a*, 5'*a* may have a plurality of modifications as described hereinafter, which are generic as a single invention concept and are not divisional.

Figure 8:
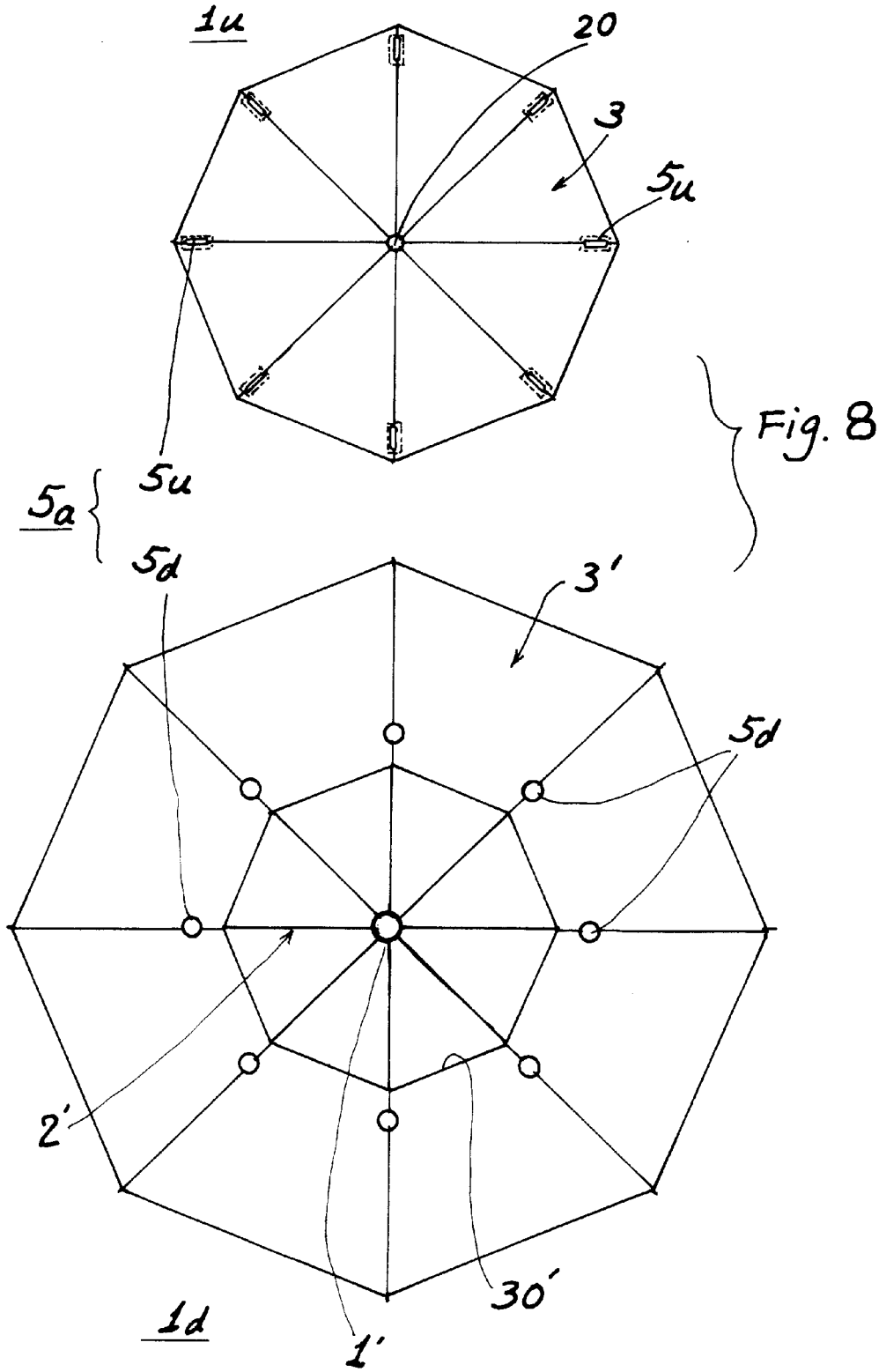
FIG. 8 is a top view showing the upper and lower cloths of another preferred embodiment of the present invention.

As shown in FIG. 8, the lower buckling member 5*d* is formed as a button which is formed on an inner periphery of the lower umbrella cloth 3' adjacent to the central opening 30' of the lower umbrella cloth 3'; and the upper buckling member 5*u* is formed as a button hole in an outer periphery of the upper umbrella cloth 3 to be engageable with the button of the lower buckling member 5*d* for coupling the upper and lower cloths 3, 3'.

Figure 9:
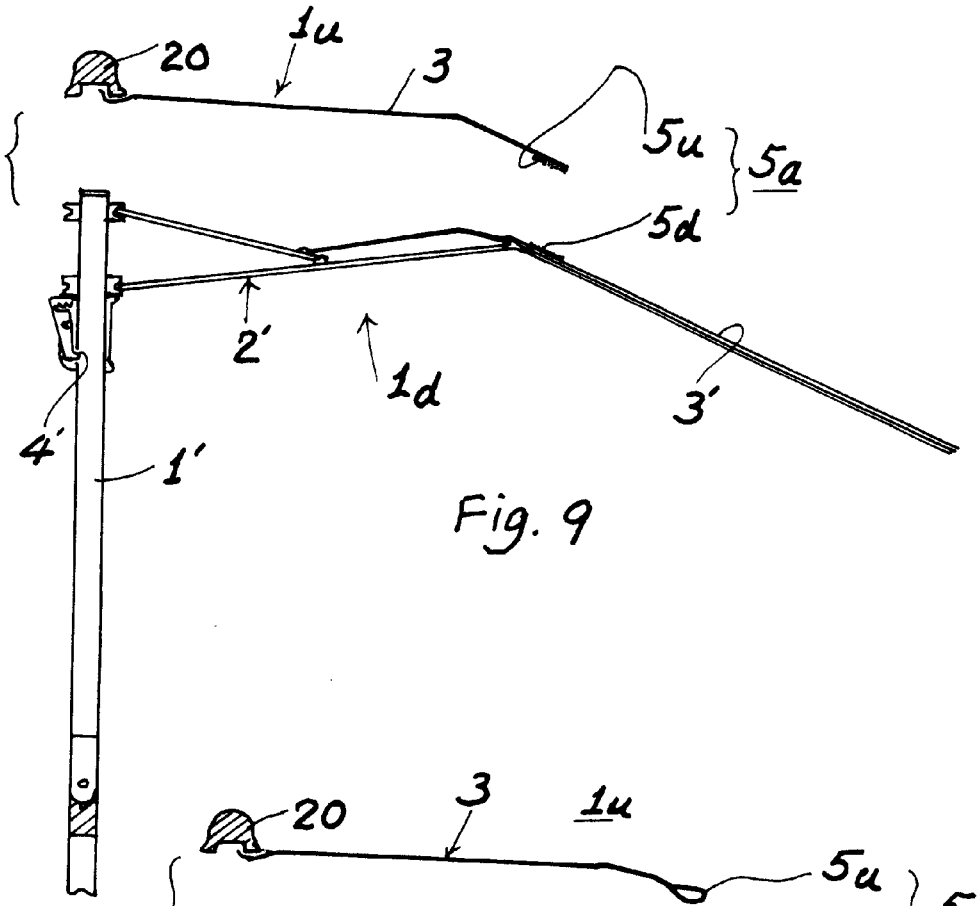
FIG. 9 shows still another preferred embodiment of the present invention.

As shown in FIG. 9, the detachable buckling means 5*a* includes: an upper buckling member 5*u* formed as an upper Velcro fastening strip (such as tiny hook threads), and a lower buckling member 5*d* formed as a lower Velcro fastening strip (such as a coarse surface) engageable with the upper Velcro fastening strip for coupling the upper and lower cloths 3, 3'.

Figure 10:
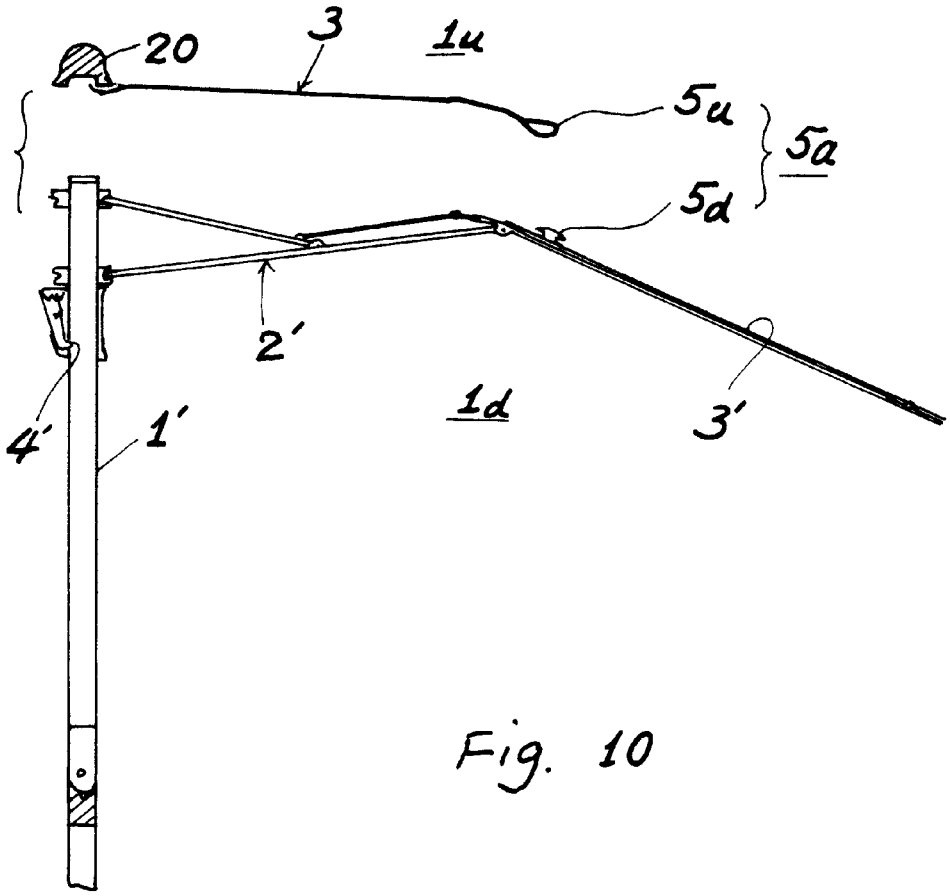
FIG. 10 shows further preferred embodiment of the present invention.

As shown in FIG. 10, the upper buckling member 5*u* is formed as a loop and the lower buckling member 5*d* is formed as a button engageable with the loop for coupling the upper and lower cloths 3, 3'.

Figure 11:
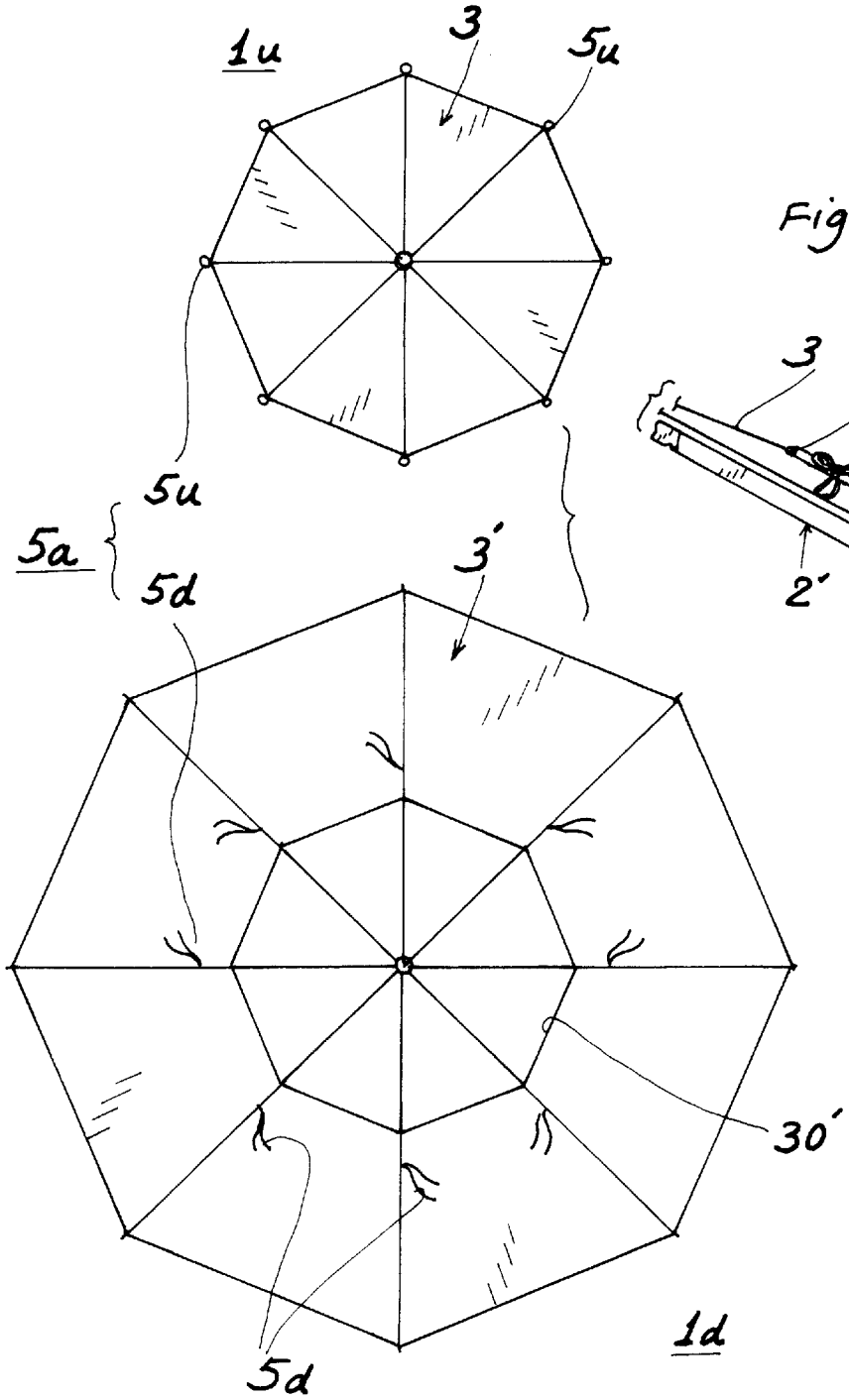
FIG. 11 is a top view showing the upper and lower umbrella cloths of still further preferred embodiment of the present invention.
Figure 12:
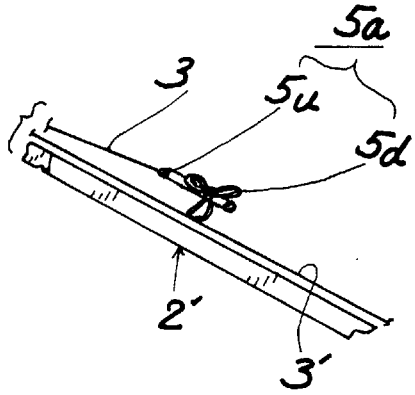
FIG. 12 is an illustration showing the coupling of the upper and lower umbrella cloths of the present invention as shown in FIG. 11.

As shown in FIGS. 11, 12, the upper buckling member 5*u* is formed as a ring, while the lower buckling member 5*d* is formed as a string or a pair of strings to be tied with the ring for coupling the upper and lower cloths 3, 3'.

We claim:

1. A double-story umbrella comprising:

a lower umbrella including a lower shaft, a lower rib assembly pivotally secured to the lower shaft, and a lower umbrella cloth secured on the lower rib assembly having a central opening formed in the lower umbrella cloth;

an upper umbrella formed with an upper umbrella cloth secured to a top of said lower shaft by a cap fixed on the top of said lower shaft; and a plurality of detachable buckling means radially disposed on said upper and lower umbrella cloths, each said detachable buckling means including an upper buckling member formed on an outer periphery of said upper umbrella cloth and a lower buckling member formed on an inner periphery of said lower umbrella cloth adjacent to said central opening of said lower umbrella cloth; whereby upon engagement of said upper buckling member on said upper umbrella cloth with said lower buckling member on said lower umbrella cloth, said upper umbrella cloth is coupled on said lower umbrella cloth for shielding said central opening; and upon uncoupling of said upper and lower buckling members and upon folding of said upper umbrella cloth, said lower umbrella cloth and said lower rib assembly on said lower shaft will be enwrapped within said upper umbrella cloth to form a compact folded umbrella.

2. A double-story umbrella according to claim 1, wherein said upper umbrella cloth further includes a tying means formed on said upper umbrella cloth for tying and fastening said upper and lower umbrella cloths as folded.

3. A double-story umbrella according to claim 1, wherein said upper buckling member is a button hole; and said lower buckling member is a button.

4. A double-story umbrella according to claim 3, wherein button hole is formed as a calabash shape, and including: a large-diameter hole, a throat portion, and a small-diameter hole having a diameter smaller than that of said large-diameter hole and larger than a width of said throat portion; and said button having a diameter equal to the diameter of said large-diameter hole and having a neck portion under said button and engaging with said small-diameter hole for coupling said upper and lower buckling members.

5. A double-story umbrella according to claim 1, wherein said upper buckling member is formed as a pair of bifurcated hook members; and said lower buckling member formed as a loop to be engaged with said bifurcated hook members.

6. A double-story umbrella according to claim 1, wherein said upper buckling member is formed as an upper fastening strip having tiny hook threads formed thereon; and a lower buckling member formed as a lower fastening strip having a coarse surface formed on said lower fastening strip to be engaged with said tiny hook threads on said upper fastening strip for coupling said upper and lower buckling members.

7. A double-story umbrella according to claim 1, wherein said upper buckling member is formed as a loop; and said lower buckling member formed as a button engaged with said loop.

8. A double-story umbrella according to claim 1, wherein said upper buckling member is a ring; and said lower buckling member formed by at least a string to be tied with said ring for coupling said upper and lower buckling members.

* * * * *